US010718135B2

(12) United States Patent
Stile

(10) Patent No.: US 10,718,135 B2
(45) **Date of Patent: *Jul. 21, 2020**

(54) ADJUSTABLE DOOR LOCK AND ASSOCIATED METHOD

(71) Applicant: Jason L. Stile, Bronx, NY (US)

(72) Inventor: Jason L. Stile, Bronx, NY (US)

(73) Assignee: AJUST LOCK, LLC, New York, NY (US)

( * ) Notice: Subject to any disclaimer, the term of this patent is extended or adjusted under 35 U.S.C. 154(b) by 284 days.

This patent is subject to a terminal disclaimer.

(21) Appl. No.: 15/198,572

(22) Filed: Jun. 30, 2016

(65) Prior Publication Data

US 2016/0312492 A1 Oct. 27, 2016

Related U.S. Application Data

(63) Continuation of application No. 14/046,964, filed on Oct. 5, 2013, now Pat. No. 9,458,651, which is a (Continued)

(51) Int. Cl.
*E05B 15/02* (2006.01)
*E05C 1/04* (2006.01)
(Continued)

(52) U.S. Cl.
CPC ..... *E05B 15/0245* (2013.01); *E05B 15/022* (2013.01); *E05C 1/04* (2013.01);
(Continued)

(58) Field of Classification Search
CPC ..... Y10T 292/705; Y10T 292/68; Y10T 292/696; Y10T 292/691; E05C 3/04;
(Continued)

(56) References Cited

U.S. PATENT DOCUMENTS 86,217 A 1/1869 Davis
114,851 A 5/1871 Preston
(Continued)

FOREIGN PATENT DOCUMENTS

GB 1117044 6/1968

*Primary Examiner* — Mark A Williams
(74) *Attorney, Agent, or Firm* — Ashkan Najafi

(57) ABSTRACT

An adjustable door lock includes a catch plate having a body and a plurality of flanges positioned on an exterior face of the body such that a corresponding gap is formed between the body and each of the flanges, respectively. Advantageously, a catch having a channel is adjustably connected to the catch plate wherein the catch is selectively interfitted through at least of one of the gaps. A door plate is disposed adjacent to the catch plate and adapted to be secured to the door. A locking bolt is in communication with the door plate and linearly reciprocated along a first linear path passing along the door plate and the channel. Notably, the catch is automatically adjusted along a second linear path orthogonally registered relative to the first linear path such that the linear channel automatically becomes axially aligned with the locking bolt as the locking bolt ingresses and egresses the catch.

18 Claims, 8 Drawing Sheets

Related U.S. Application Data continuation-in-part of application No. 12/955,552, filed on Nov. 29, 2010, now Pat. No. 8,899,634.

(60) Provisional application No. 61/264,896, filed on Nov. 30, 2009.

(51) Int. Cl.
*E05C 1/10* (2006.01)
*E05C 3/00* (2006.01)
*E05C 3/14* (2006.01)

(52) U.S. Cl.
CPC ..... *E05C 1/10* (2013.01); *E05C 3/006* (2013.01); *E05C 3/145* (2013.01); *E05B 2015/027* (2013.01)

(58) Field of Classification Search
CPC .... Y10S 292/40; Y10S 292/39; Y10S 292/60; E05B 15/0006; E05B 63/244; E05B 15/024
USPC ..... 292/145–146, 150, 302
See application file for complete search history.

(56) References Cited

U.S. PATENT DOCUMENTS

| | | | | | |
|---|---|---|---|---|---|
| 836,463 | A | * | 11/1906 | Rapson | |
| 2,403,065 | A | * | 7/1946 | Engert | E05C 1/04 292/340 |
| 3,315,999 | A | | 4/1967 | Hahn | |
| 3,734,551 | A | * | 5/1973 | Hughes | E05C 19/066 24/662 |
| 4,056,275 | A | * | 11/1977 | Keeler, II | E05C 19/066 292/17 |
| 2010/0180511 | A1 | * | 7/2010 | Mahdi | E05B 15/02 49/501 |
| 2014/0203569 | A1 | | 7/2014 | Stile | |

* cited by examiner

ADJUSTABLE DOOR LOCK AND ASSOCIATED METHOD

CROSS REFERENCE TO RELATED APPLICATIONS

This is a continuation application of currently pending U.S. patent application Ser. No. 14/046,964 filed Oct. 5, 2013, which is a continuation-in-part application of U.S. patent application Ser. No. 12/955,552 filed Nov. 29, 2010, issued on Dec. 2, 2014 as U.S. Pat. No. 8,899,634, which claims the benefit of U.S. provisional application No. 61/264,896 filed Nov. 30, 2009, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE DISCLOSURE

1. Technical Field

This disclosure relates to door locks and, more particularly, to an adjustable door lock for providing users with an easy and convenient means of locking offset and misaligned doors.

2. Prior Art

A barrel bolt is a sliding lock mechanism used to provide security for both average and heavy weight doors and windows. The bolt is surface mounted where the bolt slides into a catch on the other side of the door. Barrel bolts are most suitable for single leaf doors and passive leaf of double doors. They find wide application throughout industry and commerce; especially where a high level of physical security is required. These bolts are easy to fit and are available in a wide range of sockets. Some barrel bolts have spring action to hold the bolt in place while some others are lockable. These bolts are available in various sizes and come in various decorative finishes and with surface or universal strikes. Some barrel bolts are plain, simple looking while some others are highly decorative which are just perfect for installing on cabinet doors, windows etc.

Barrel bolts are installed on a variety of doors, and require high degree accuracy on installation, so that the bolt and catch align when engaged. Even when installed properly, the bolt and catch will become misaligned as the door and wall of the building shifts through use. This issue is common among barrel bolts, and to fix the issue homeowners or leasing managers must re-position the barrel bolt to realign, or find another inconvenient means of remedy. Usually either the lock or the catch has to be removed and the door and wall may require some annoying cosmetic repairs.

Through the effects of temperature fluctuations and structural stresses induced when constructing a building, there is a tendency for the doors of buildings to shift from their original positions thus causing these doors to be misaligned with its frame over time. The shifting may cause the locking bolts and catches of these doors to be misaligned thereby causing the doors to be unboltable.

Accordingly, a need remains for a device in order to overcome the above-noted shortcomings. The present disclosure satisfies such a need by providing an adjustable door lock that is convenient and easy to use, lightweight yet durable in design, versatile in its applications, and designed for providing an easy means of locking offset and misaligned doors. In particular, the advantageous structural configuration of the present disclosure disclosed provides the unexpected and unpredictable advantage of automatically aligning the locking bolt to the catch of these misaligned doors without the need for removing and refitting the locking bolt or catch.

BRIEF SUMMARY OF THE DISCLOSURE

In view of the foregoing background, it is therefore an object of the present disclosure to provide an apparatus for locking a misaligned or off-set door relative to support wall adjacent to the door. These and other objects, features, and advantages of the disclosure are provided by an adjustable door lock.

In a non-limiting exemplary embodiment, an adjustable door lock for locking a misaligned or off-set door relative to a support wall adjacent to the door includes a catch plate adapted to be secured adjacent to the door and having a channel formed therein. Such a catch plate further has a body and a plurality of flanges positioned on an exterior face of the body such that a corresponding gap is formed between the body and each of the flanges, respectively. Advantageously, the catch is adjustably connected to the catch plate and interfitted through at least of one of the gaps. A door plate disposed adjacent to the catch plate and adapted to be secured to the door. A locking bolt in communication with the door plate and linearly reciprocated along a first linear path passing along the door plate and the channel. Notably, the catch is automatically adjusted along a second linear path orthogonally registered relative to the first linear path such that the linear channel automatically becomes axially aligned with the locking bolt as the locking bolt ingresses and egresses the catch.

In a non-limiting exemplary embodiment, the first linear path is bi-directional and oriented along a horizontal plane while the second linear path is bi-directional and oriented along a vertical plane.

In a non-limiting exemplary embodiment, the locking bolt linearly traverses the second linear path upon ingressing and egressing the linear channel respectively.

In a non-limiting exemplary embodiment, the catch flanges remain statically mated to the catch plate as the catch is displaced along the second linear path.

In a non-limiting exemplary embodiment, the catch includes a plurality of guides diverging away from the linear channel towards the door plate for guiding the locking bolt along the linear channel.

In a non-limiting exemplary embodiment, the guides converge towards the linear channel away from the door plate for guiding the locking bolt along the linear channel.

In a non-limiting exemplary embodiment, the locking bolt includes a handle located at a proximal end thereof. Such a handle is rotated about the first linear path thereby displacing the handle between locked and unlocked positions relative to the door plate.

In a non-limiting exemplary embodiment, the door plate includes a main section registered generally parallel to a major longitudinal length of the locking bolt and, an auxiliary section registered generally orthogonal to the main section.

In a non-limiting exemplary embodiment, the handle passes through the auxiliary section. Such a handle includes a first section disposed proximal to the auxiliary section, and a second section disposed distal to the auxiliary section. Advantageously, the main section is disposed subjacent to the auxiliary section such that the locking bolt is prohibited from axially sliding along the first linear path.

A method for using an adjustable door lock for locking a misaligned or off-set door relative to a support wall adjacent to the door. Such a method includes the steps of: providing a catch plate adapted to be secured adjacent to the door wherein the catch plate has a body and a plurality of flanges positioned on an exterior face of the body such that a corresponding gap is formed between the body and each of the flanges, respectively; and providing and adjustably connecting a catch to the catch plate thereby interfitting the catch through at least of one of the gaps. Such a catch has a channel formed therein.

The method further includes the steps of: providing and disposing a door plate adjacent to the catch plate wherein the door plate is adapted to be secured to the door; providing and communicating a locking bolt with the door plate such that the locking bolt is capable of being linearly reciprocated along a first linear path passing along the door plate and the channel; and automatically adjusting the catch along a second linear path orthogonally registered relative to the first linear path such that the linear channel automatically becomes axially aligned with the locking bolt as the locking bolt ingresses and egresses the catch.

The first linear path may further traverse the second linear path and may be bi-directional and oriented along a horizontal plane while the second linear path may be bi-directional and oriented along a vertical plane. In this way, the locking bolt may linearly traverse the second linear path upon ingressing and egressing the linear channel respectively while the catch brackets remain statically mated to the catch plate as the catch is displaced along the second linear path. Such an arrangement provides the unexpected and unpredictable advantage of providing a self-adjusting mechanism to the catch when a misaligned locking bolt is inserted into its linear channel.

The catch may include a plurality of guides diverging away from the linear channel towards the door plate for guiding the locking bolt along the linear channel. The plurality of guides may converge towards the linear channel away from the door plate for guiding the locking bolt along the linear channel. Such an arrangement provides the unexpected and unpredictable advantage of ensuring that the locking bolt is guided into the catch easily without requiring an added step of aligning the catch to the locking bolt by the user.

The locking bolt may include a handle such that the locking bolt may be rotated about the first linear path thereby displacing the handle between locked and unlocked positions relative to the door plate.

The present disclosure further includes a method of utilizing an adjustable door lock for locking a misaligned or off-set door relative to support wall adjacent to the door. Such a method may include the chronological steps of: providing and securing a catch plate adjacent to the door; providing a plurality of catch brackets; providing a catch preferably having a linear channel formed therein; adjustably connecting the catch to the catch plate by interfitting the catch through the catch brackets; connecting the catch brackets to the catch plate; providing and disposing a door plate adjacent to the catch plate; providing and housing a locking bolt within the door plate; securing the door plate to the door; linearly reciprocating the locking bolt along a first linear path passing through the door plate and the linear channel; automatically adjusting the catch along a second linear path orthogonally registered relative to the first linear path by ingressing and egressing the locking bolt through the catch; and automatically and axially aligning the linear channel with the locking bolt.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the disclosure of the application, which is measured by the claims, nor is it intended to be limiting as to the scope of the disclosure in any way.

BRIEF DESCRIPTION OF THE SEVERAL VIEWS OF THE DRAWING

The novel features believed to be characteristic of this disclosure are set forth with particularity in the appended claims. The disclosure itself, however, both as to its organization and method of operation, together with further objects and advantages thereof, may best be understood by reference to the following description taken in connection with the accompanying drawings in which:

Figure 1:
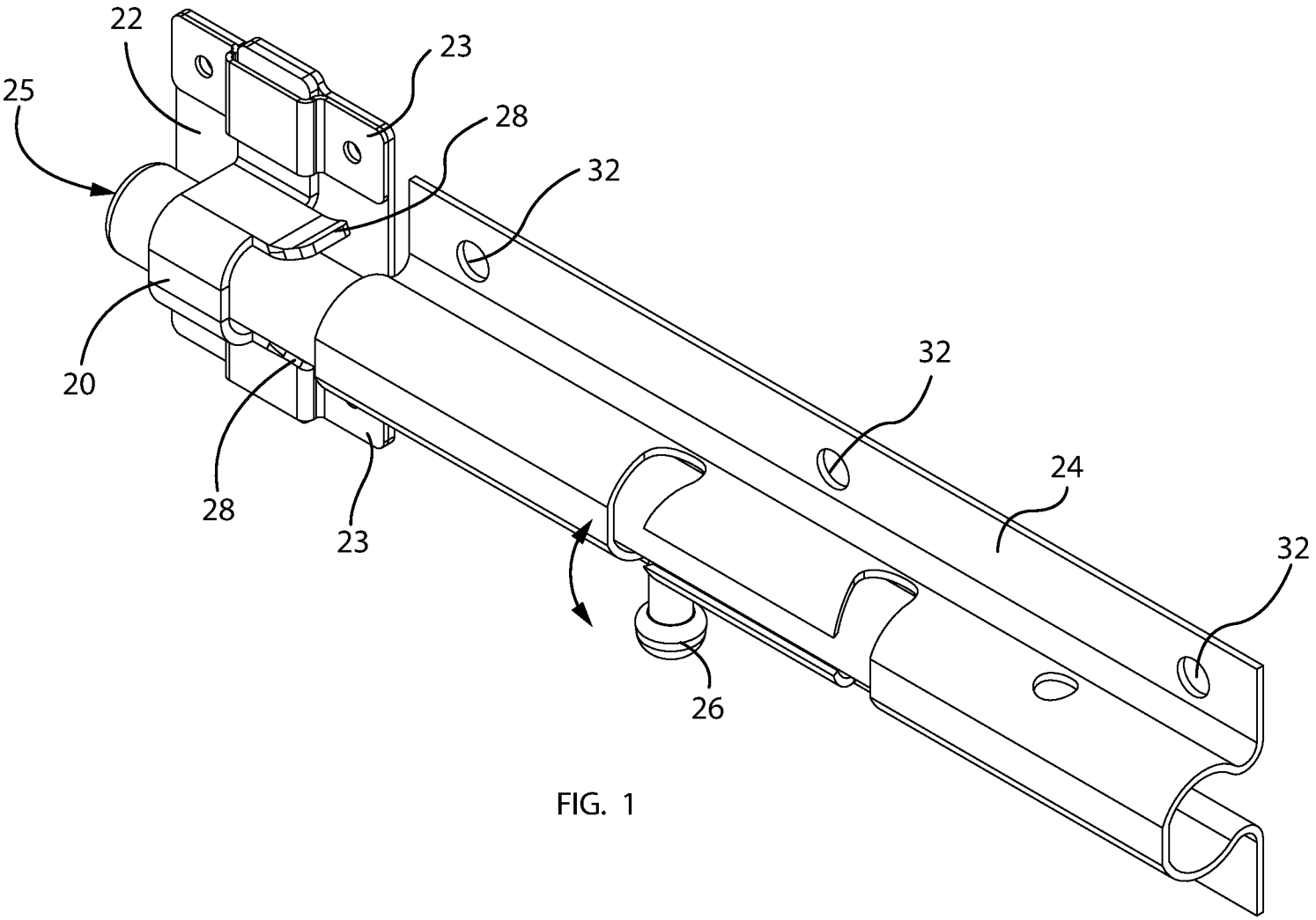
FIG. 1 is a perspective view showing an adjustable door lock in a locked position, in accordance with one embodiment of the present disclosure, wherein brackets are removably mated to the catch plate.

Those skilled in the art will appreciate that the figures are not intended to be drawn to any particular scale; nor are the figures intended to illustrate every embodiment of the disclosure. The disclosure is not limited to the exemplary embodiments depicted in the figures or the shapes, relative sizes or proportions shown in the figures.

DETAILED DESCRIPTION OF THE DISCLOSURE

The present disclosure will now be described more fully hereinafter with reference to the accompanying drawings, in which a preferred embodiment of the disclosure is shown. This disclosure may, however, be embodied in many different forms and should not be construed as limited to the embodiment set forth herein. Rather, this embodiment is provided so that this application will be thorough and complete, and will fully convey the true scope of the disclosure to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present disclosure" merely for convenience and without intending to voluntarily limit the scope of this application to any particular disclosure or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present disclosure. Thus, to the maximum extent allowed by law, the scope of the present disclosure is to be determined by the broadest permissible interpretation of the following claims and their equivalents, and shall not be restricted or limited by the foregoing detailed description.

The device of this disclosure is referred to generally in FIGS. 1-5 and is intended to provide an adjustable door lock. It should be understood that the present disclosure may be used to provide a door lock for off-set and misaligned doors as well as different types of movable barriers, and should not be limited to the uses described herein.

Figure 2:
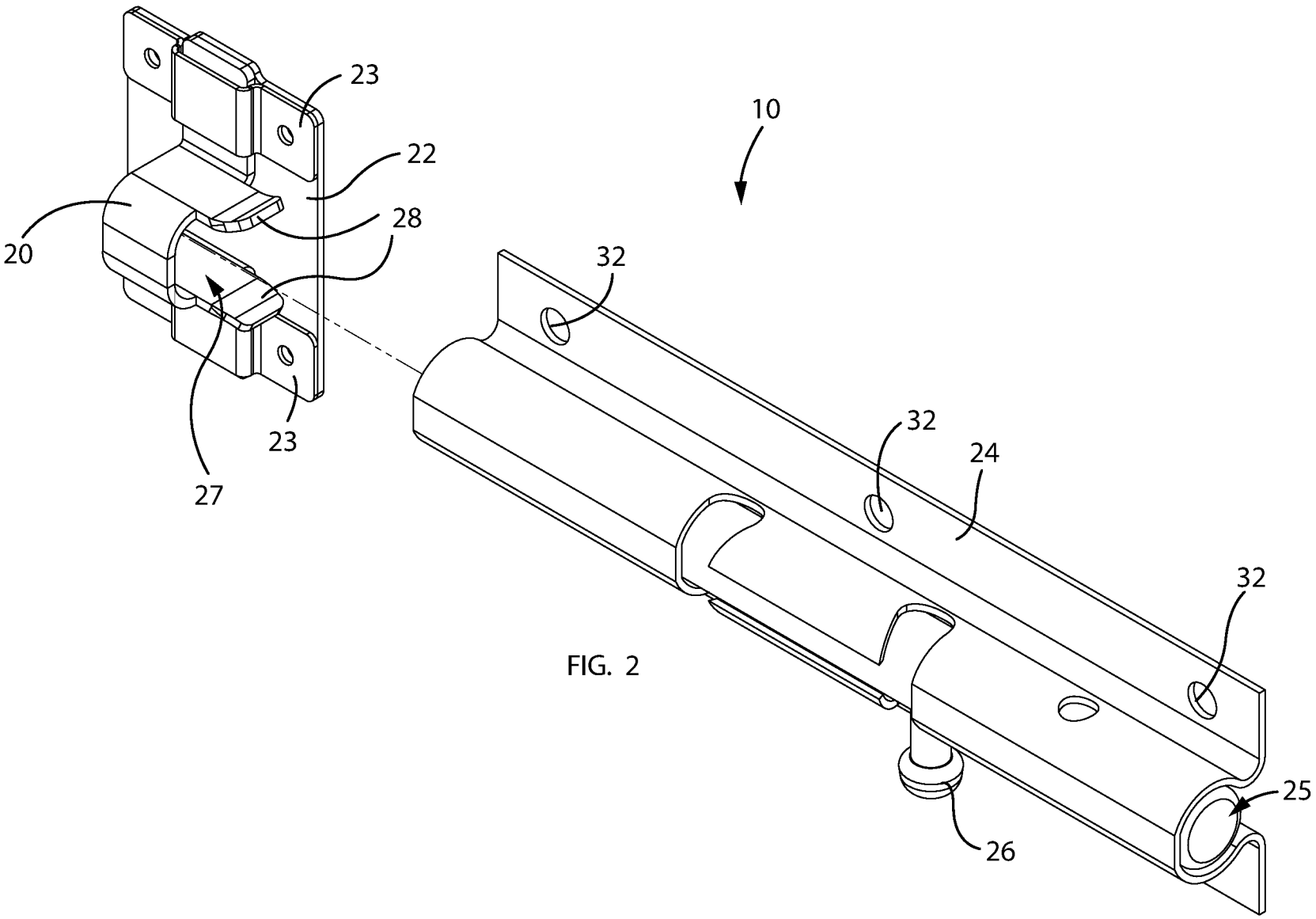
FIG. 2 is an exploded view of the adjustable door lock shown at an unlocked position.
Figure 3:
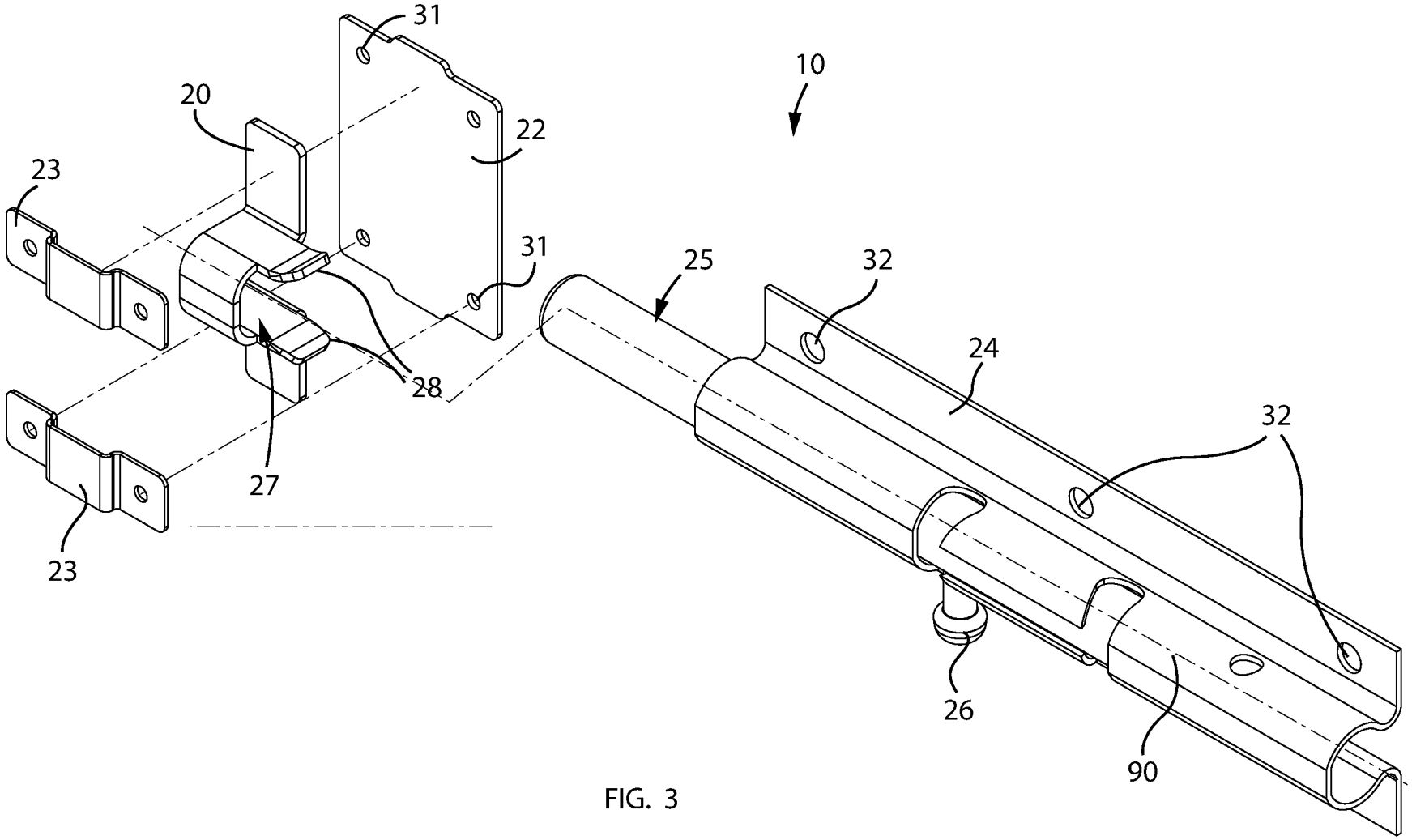
FIG. 3 is an exploded view of the adjustable door lock shown in FIG. 1.
Figure 4:
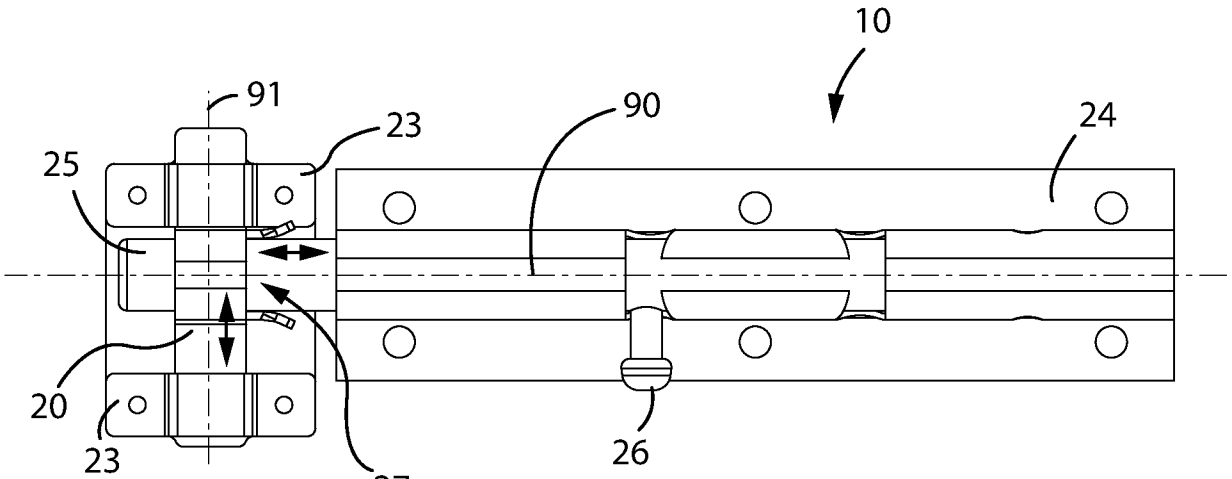
FIG. 4 is a front elevational view of the adjustable door lock showing the catch upwardly aligned relative to the locking bolt.
Figure 5:
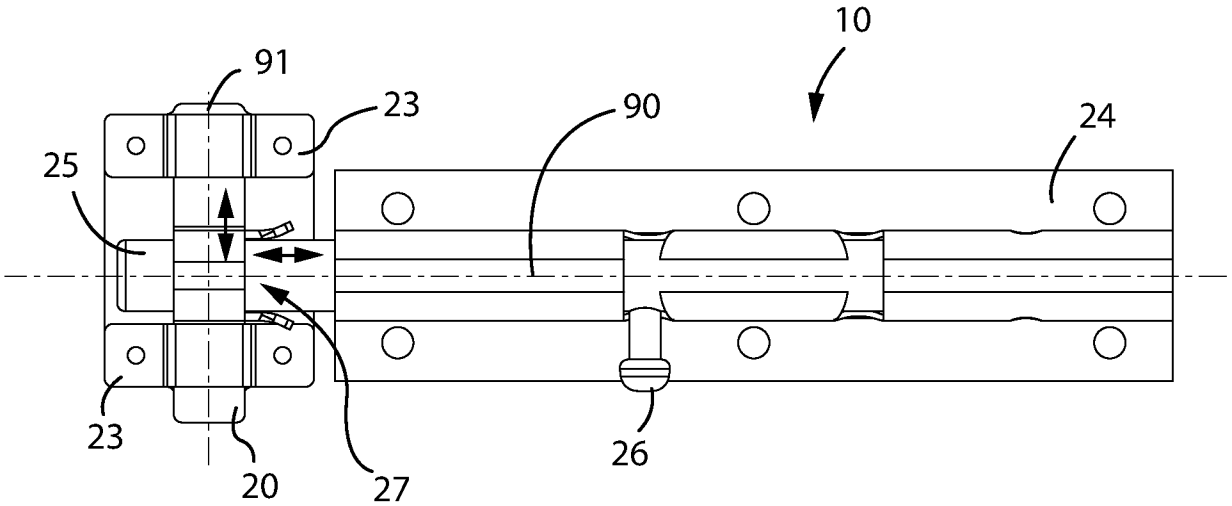
FIG. 5 is front elevational view of the adjustable door lock showing the catch downwardly aligned relative to the locking bolt.
Figure 6:
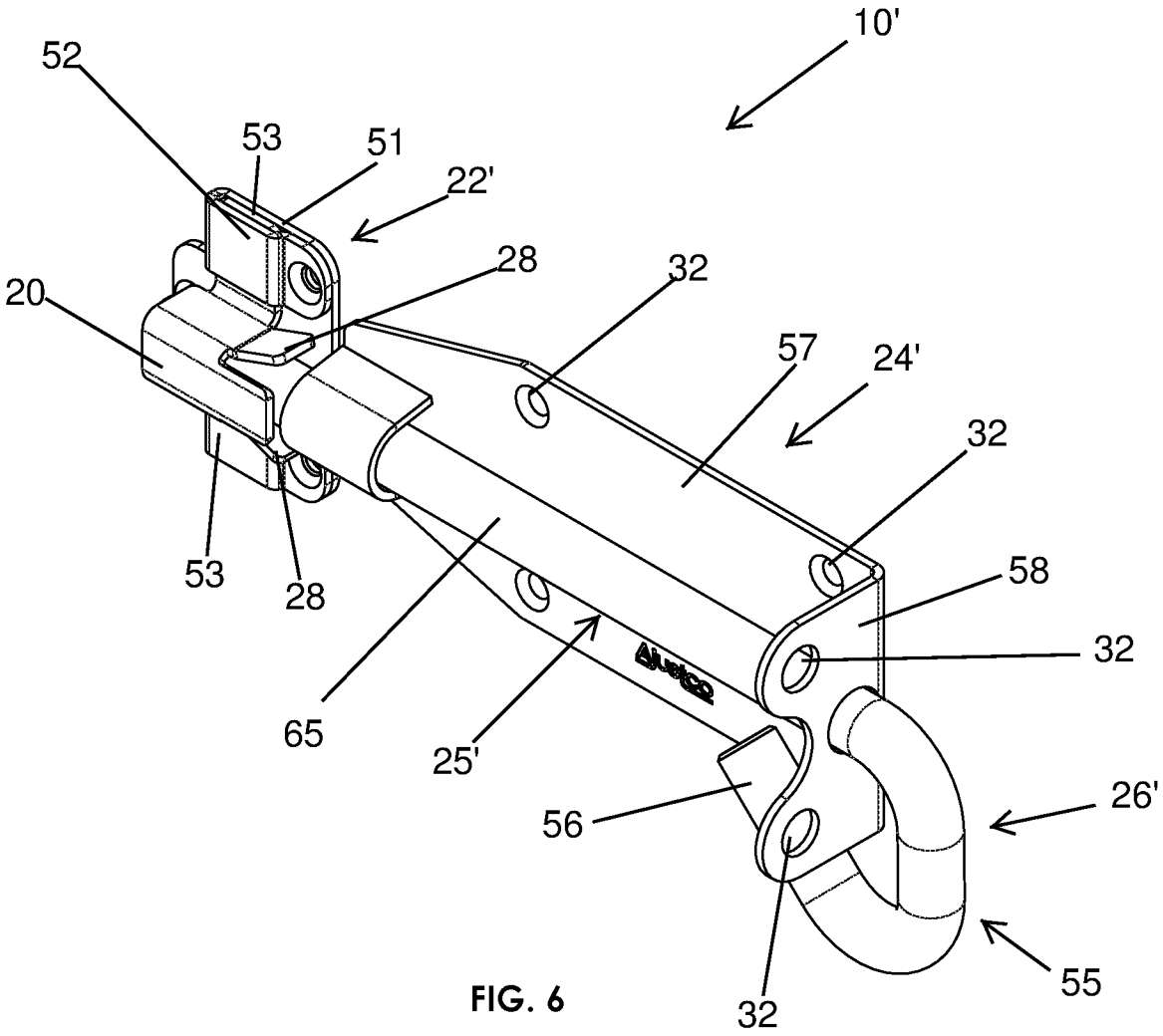
FIG. 6 is a perspective view showing an adjustable door lock in a locked position, in accordance with one embodiment of the present disclosure, wherein the catch plate has flanges folded thereover in lieu of employing removable brackets.
Figure 7:
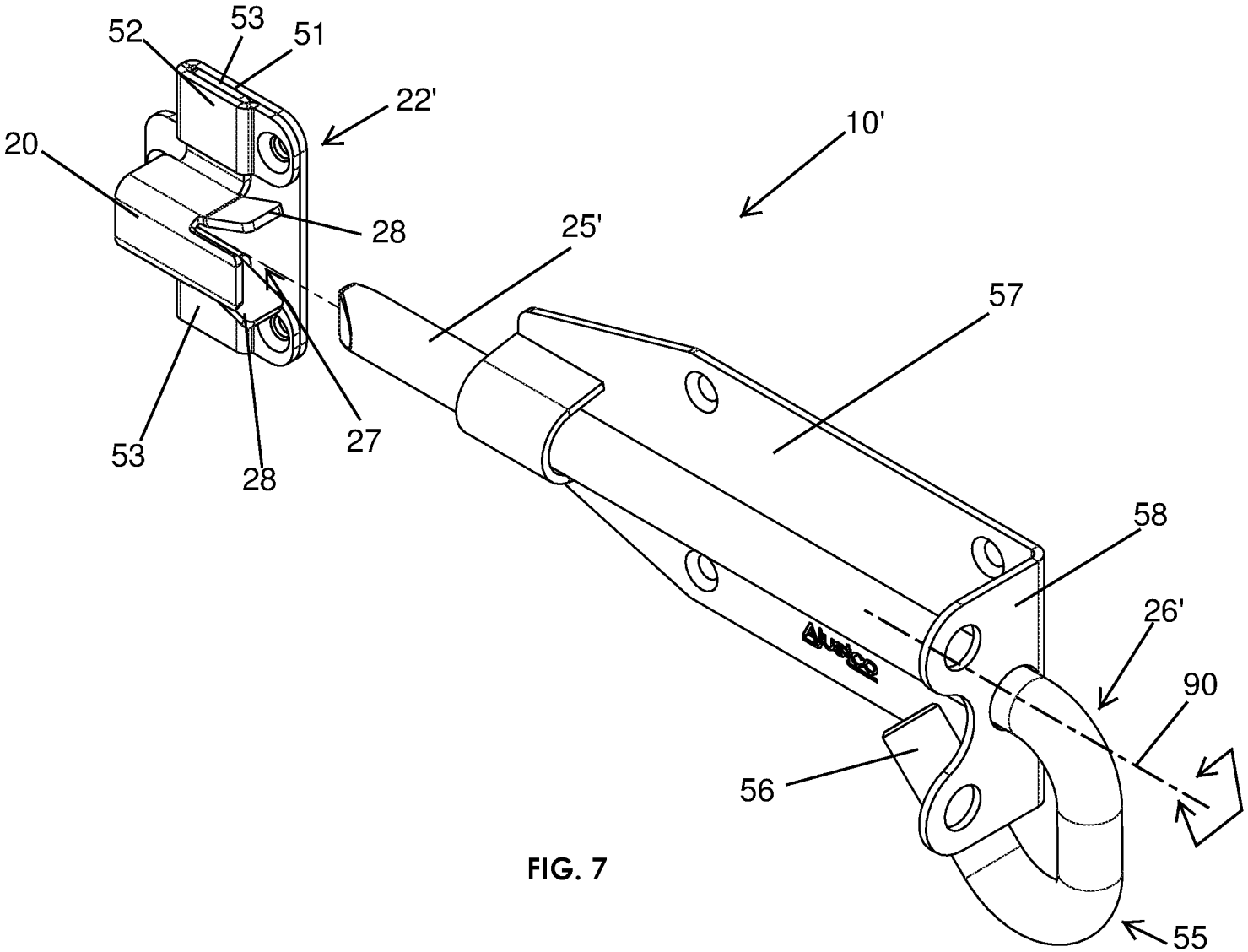
FIG. 7 is an exploded view of the adjustable door lock shown at an unlocked position.
Figure 8:
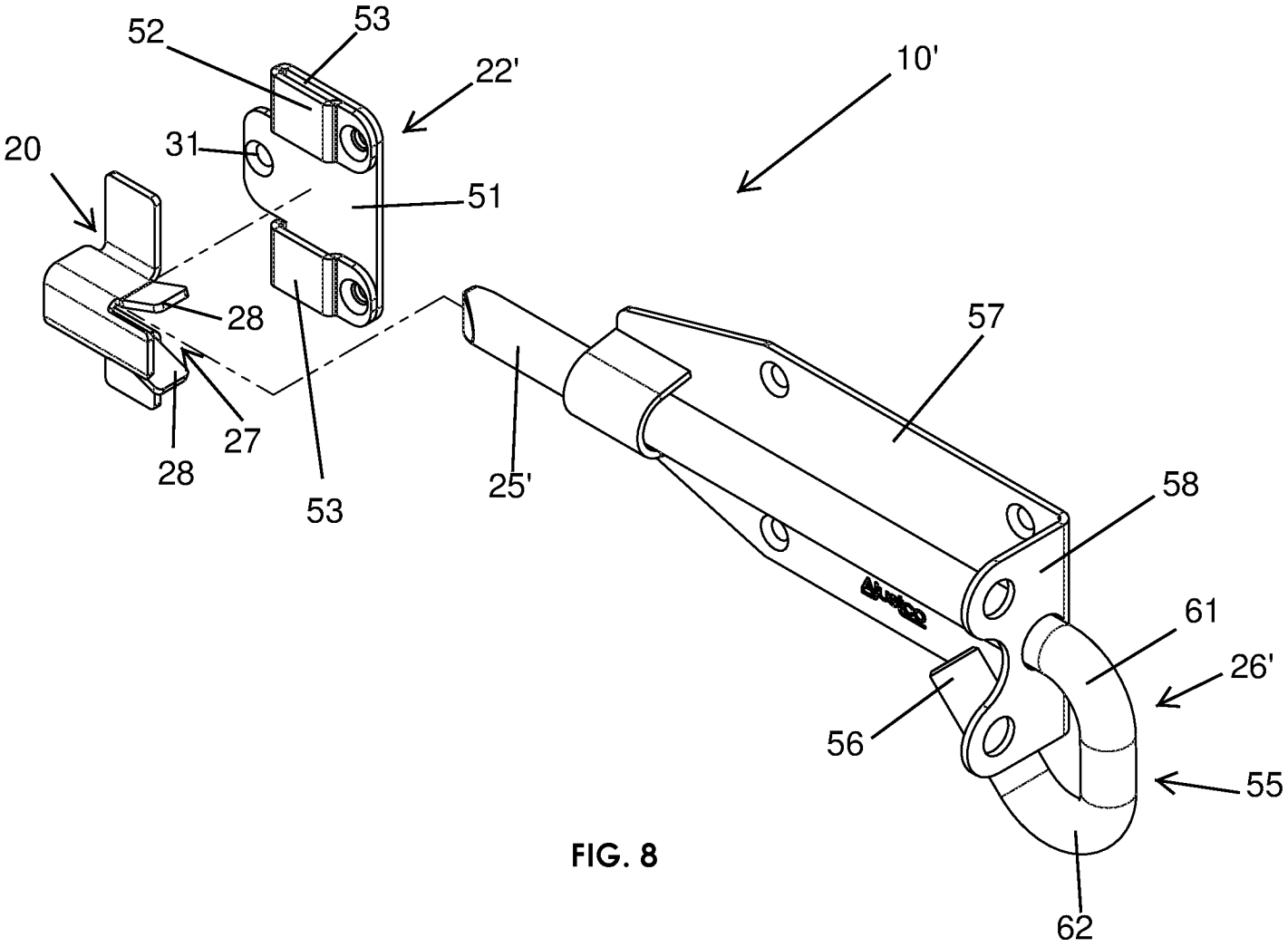
FIG. 8 is an exploded view of the adjustable door lock shown in FIG. 1.
Figure 9:
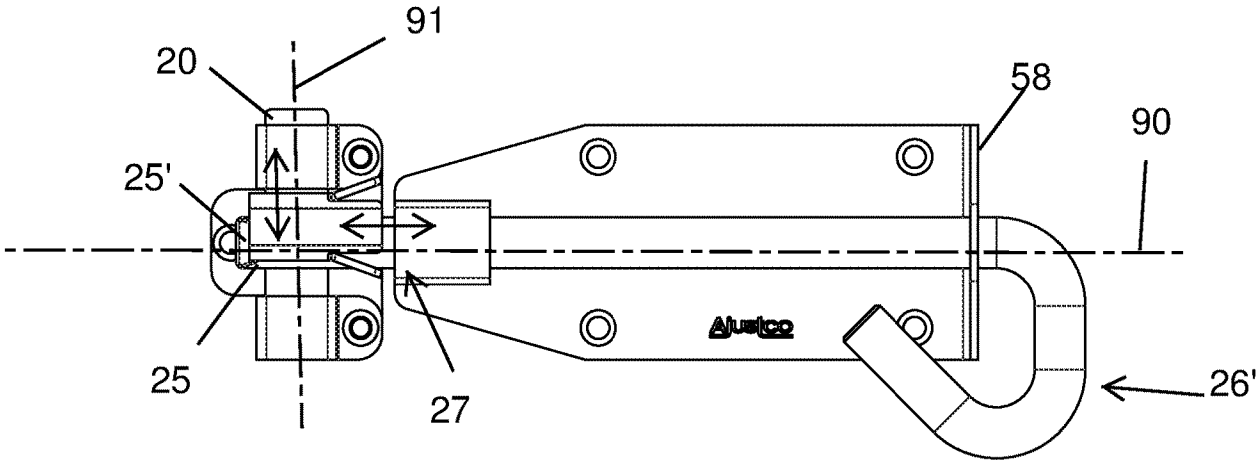
FIG. 9 is a front elevational view of the adjustable door lock showing the catch upwardly aligned relative to the locking bolt.
Figure 10:
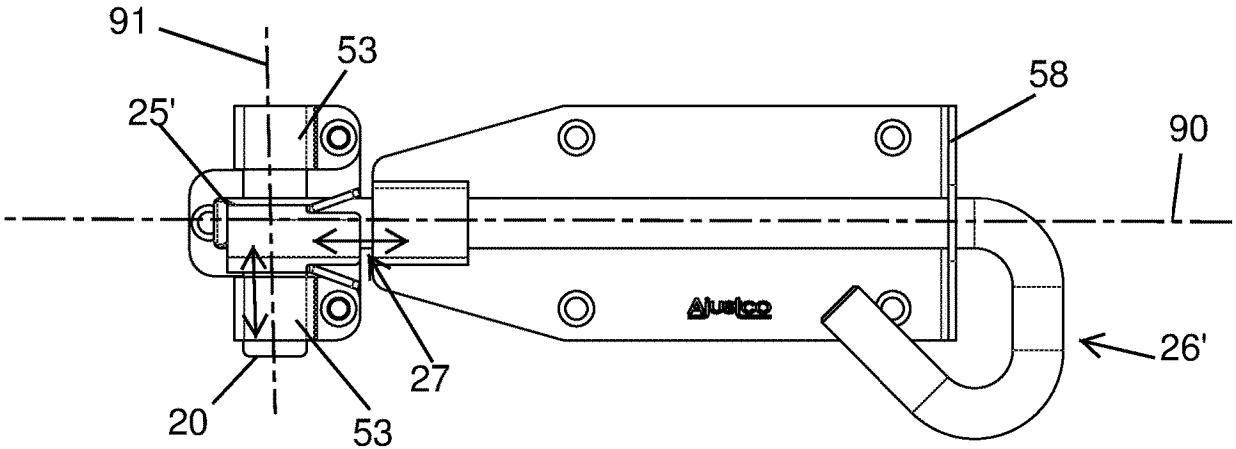
FIG. 10 is front elevational view of the adjustable door lock showing the catch downwardly aligned relative to the locking bolt.

Referring to FIGS. 1-5, the adjustable door lock 10 may include a catch plate 22 adapted to be secured adjacent to a door (not shown), such as a wall or a portion of a door frame. A plurality of catch brackets 23 may be connected to the catch plate 22. A catch 20 may be adjustably connected to the catch plate 22 and interfitted through the catch brackets 23. Such a catch 20 preferably has a linear channel 27 formed therein. A door plate 24 may be disposed adjacent to the catch plate 22 and adapted to be secured to the door (not shown). As best shown in FIGS. 4 and 5, a locking bolt 25 may be housed within the door plate 24 and may be linearly reciprocated along a first linear path 90 passing through the door plate 24 and the linear channel 27. Such a structural arrangement provides the unpredicted and unexpected advantage of automatically adjusting the catch 20 along a second linear path 91 that is orthogonally registered relative to the first linear path 90 such that the linear channel 27 automatically becomes axially aligned with the locking bolt 25 as the locking bolt 25 ingresses and egresses the catch 20.

From exposure to temperature fluctuations and structural stresses during building construction, doors/frames shift from their original positions and thereby become misaligned over time. Such misalignment causes conventional locking bolts and catches to become misaligned thereby preventing easy locking/unlocking. The present disclosure provides the unexpected and unpredictable advantage of automatically aligning the locking bolt 25 with the catch 20 during such misalignment without the need for removing and refitting the locking bolt 25 or catch 20.

Referring to FIGS. 4 and 5, the first linear path 90 may traverse the second linear path 91 and may be bi-directionally oriented along a horizontal plane while the second linear path 91 may be bi-directionally oriented along a vertical plane. In this way, the locking bolt 25 may linearly traverse the second linear path 91 upon ingressing and egressing the linear channel 27 respectively, while the catch brackets 23 remain statically mated to the catch plate 22 as the catch 20 is displaced along the second linear path 91. Such an arrangement provides the unexpected and unpredictable advantage of providing a self-adjusting catch 20 when a misaligned locking bolt 25 is inserted into its linear channel 27, without undesirably shifting the catch brackets 23.

Referring to FIGS. 1-3, the catch 20 may include a plurality of guides 28, diverging away from the linear channel 27 and towards the door plate 24 for guiding the locking bolt 25 along the linear channel 27. Such guides 28 preferably converge towards the linear channel 27 and away from the door plate 24 for guiding the locking bolt 25 along the linear channel 27. Such a structural arrangement provides the unexpected and unpredictable advantage of ensuring locking bolt 25 is smoothly guided into the catch 20 without requiring an added step of aligning the catch 20 to the locking bolt 25 by the user.

Referring to FIGS. 1-3 again, the locking bolt 25 may include a handle 26 such that locking bolt 25 may be rotated about the first linear path 90 (see FIG. 3) thereby displacing the handle 26 between locked and unlocked positions relative to the door plate 24. Such a structural arrangement provides the benefit of freely rotating locking bolt 25 while ingressed and egressed from linear channel 27.

The present disclosure may include a method of utilizing an adjustable door lock 10 for locking a misaligned or off-set door relative to support wall adjacent to the door. Such a method may include the chronological steps of: providing and securing a catch plate 22 adjacent to the door; providing a plurality of catch brackets 23; providing a catch 20 preferably having a linear channel 27 formed therein; connecting the catch brackets 23 to the catch plate 22; and adjustably connecting the catch 20 to the catch plate 22 by interfitting the catch 20 through the catch brackets 23.

Such a method may further include the chronological steps of: providing and disposing a door plate 24 adjacent to the catch plate 22; providing and housing a locking bolt 25 within the door plate 24; securing the door plate 24 to the door; linearly reciprocating the locking bolt 25 along a first linear path 90 passing through the door plate 24 and the linear channel 27; automatically adjusting the catch 20 along a second linear path 91 orthogonally registered relative to the first linear path 90 by ingressing and egressing the locking bolt 25 through the catch 20; and automatically and axially aligning the linear channel 27 with the locking bolt 25.

As a non-limiting exemplary embodiment, the catch plate 22 may further include a plurality of holes 31 such that a plurality of screws may be inserted to fixedly engage the catch plate 22 with a door frame. Guides 28 may extend outwardly from the linear channel 27 such that the distal end portions of the guides 28 may be wider than the linear channel 27. In this way, the guides 28 may form a generally "V" shaped path thereby enabling the locking bolt 25 to slidably enter the linear channel 27 and may easily secure the locking bolt 25 to a locked position. As noted hereinabove, catch 20 is slidably mated to the catch plate 22 by catch brackets 23 such that the catch 20 is automatically aligned with the locking bolt 25 even if there is a change in the door alignment relative to the linear channel 27.

As a non-limiting example, locking bolt 25 may be slidably enclosed within the linear channel 27 formed on the first linear path 90 of the door plate 24. The locking bolt handle 26 may be fixedly mated to the locking bolt 25 such that the handle 26 may be slidably engaged with the catch 20 in a locked and an unlocked position on the door plate 24. Referring to FIGS. 1-3, the door plate 24 may include a plurality of holes 32 that receive fasteners to engage the door plate 24 fixedly with a door.

Referring to FIGS. 6-10, a non-limiting exemplary embodiment of the door lock 10' replaces brackets 23 with a modified catch plate 22' as explained hereinbelow. Also, the door plate 24' and handle 26' are modified to provide additional security. The modified catch plate 22' has a body 51 and a plurality of flanges 52 positioned on an exterior face of the body 51 such that a corresponding gap 53 is formed between the body 51 and each of the flanges 52, respectively. Advantageously, a catch 20 having a channel 27 formed therein is adjustably connected to the catch plate 22' and interfitted through at least of one of the gaps 53. A door plate 24' is disposed adjacent to the catch plate 22' and adapted to be secured to the door. A locking bolt 25' is in communication with the door plate 24' and linearly reciprocated along a first linear path 90 passing along the door plate 24' and the channel 27. Notably, the catch 20 is automatically adjusted along a second linear path 91 orthogonally registered relative to the first linear path 90 such that the linear channel 27 automatically becomes axially aligned with the locking bolt 25' as the locking bolt 25' ingresses and egresses the catch 20.

Referring to FIGS. 6-10, in a non-limiting exemplary embodiment, the first linear path 90 is bi-directional and oriented along a horizontal plane while the second linear path 91 is bi-directional and oriented along a vertical plane.

Referring to FIGS. 6-10, in a non-limiting exemplary embodiment, the locking bolt 25' linearly traverses the second linear path 91 upon ingressing and egressing the linear channel 27 respectively.

Referring to FIGS. 6-10, in a non-limiting exemplary embodiment, the flanges 52 remain statically mated to body 51 as the catch 20 is displaced along the second linear path 91.

Referring to FIGS. 6-10, in a non-limiting exemplary embodiment, the catch 20 includes a plurality of guides 28 diverging away from the linear channel 27 towards the door plate 24' for guiding the locking bolt 25' along the linear channel 27.

Referring to FIGS. 6-10, in a non-limiting exemplary embodiment, the guides 28 converge towards the linear channel 27 away from the door plate 24' for guiding the locking bolt 25' along the linear channel 27.

Referring to FIGS. 6-10, in a non-limiting exemplary embodiment, the locking bolt 25' includes a handle 26' located at a proximal end thereof. Such a handle 26' is rotated about the first linear path 90 thereby displacing the handle 26' between locked and unlocked positions relative to the door plate 24'.

Referring to FIGS. 6-10, in a non-limiting exemplary embodiment, the door plate 24' includes a main section 57 registered generally parallel to a major longitudinal linear section 65 of the locking bolt 25' and, an auxiliary section 58 is registered generally orthogonal to the main section 57. In this manner, the locking bolt 25' is prohibited from axially reciprocating along the first linear path 90 when the handle 26' is rotated subjacent to linear section 25.

Referring to FIGS. 6-10, in a non-limiting exemplary embodiment, the handle 26' passes through the auxiliary section 58. Such a handle 26' includes a first section 55 disposed proximal to the auxiliary section 58, and a second section 56 disposed distal to the auxiliary section 58. Advantageously, when the handle 26' is disposed subjacent to the longitudinal linear section 65, the locking bolt 25' is prohibited from axially sliding along the first linear path 90. The first section 55 may have at least one radius of curvature, while second section 56 may be linear. The auxiliary section 58 of door plate 24' is aligned at a transition juncture between the first and second sections 55, 56 of the handle 26'.

Referring to FIGS. 6-10, in a non-limiting exemplary embodiment, a method for using an adjustable door lock for locking a misaligned or off-set door relative to a support wall adjacent to the door, is disclosed. Such a method includes the steps of: providing a catch plate 22' adapted to be secured adjacent to the door wherein the catch plate 22' has a body 51 and a plurality of flanges 52 positioned on an exterior face of the body 51 such that a corresponding gap 53 is formed between the body 51 and each of the flanges 52, respectively; and providing and adjustably connecting a catch 20 to the catch plate 22' thereby interfitting the catch 20 through at least of one of the gaps 53. Such a catch 20 has a channel 27 formed therein.

Referring to FIGS. 6-10, the method further includes the steps of: providing and disposing a door plate 24' adjacent to the catch plate 22' wherein the door plate 24' is adapted to be secured to the door; providing and communicating a locking bolt 25' with the door plate 24' such that the locking bolt 25' is capable of being linearly reciprocated along a first linear path 90 passing along the door plate 24' and the channel 27; and automatically adjusting the catch 20 along a second linear path 91 orthogonally registered relative to the first linear path 90 such that the linear channel 27 automatically becomes axially aligned with the locking bolt 25' as the locking bolt 25' ingresses and egresses the catch 20.

Notably, the door lock 10, 10' advantageously allows the catch 20, 20' and the locking bolt 25 to be automatically adjusted to compensate for any misalignment of the door relative to a support surface during extended use.

While the disclosure has been described with respect to a certain specific embodiment, it will be appreciated that many modifications and changes may be made by those skilled in the art without departing from the spirit of the disclosure. It is intended, therefore, by the appended claims to cover all such modifications and changes as fall within the true spirit and scope of the disclosure. In particular, with respect to the above description, it is to be realized that the optimum dimensional relationships for the parts of the present disclosure may include variations in size, materials, shape, form, function and manner of operation.

What is claimed as new and what is desired to secure by Letters Patent of the United States is:

1. An adjustable door lock for locking a misaligned or off-set door relative to a support wall adjacent to the door, said adjustable door lock comprising:

a catch plate;

a catch being adjustably connected to said catch plate and having a channel formed therein;

a door plate disposed adjacent to said catch plate; and a locking bolt supported by said door plate and reciprocated along a first linear path passing along said door plate and said channel when said channel of said catch is aligned with said first linear path;

wherein said catch is adjusted along a second linear path orthogonally registered relative to said first linear path when said channel of said catch is aligned with said first linear path such that said channel becomes axially aligned with said locking bolt as said locking bolt ingresses and egresses said catch;

wherein a proximal end of said locking bolt extends beyond said door plate;

wherein said catch plate has a body and a plurality of flanges positioned on an exterior face of said body such that a corresponding gap is formed between said body and each of said flanges, respectively; wherein said catch is configured to be positioned and selectively displaced along said first linear path and through at least of one of said gaps.

2. The adjustable door lock of claim 1, wherein said first linear path is bi-directional and oriented along a horizontal plane while said second linear path is bi-directional and oriented along a vertical plane; wherein said first linear path traverses said second linear path.

3. The adjustable door lock of claim 1, wherein said locking bolt linearly, traverses said second linear path upon ingressing and egressing said linear channel respectively.

4. The adjustable door lock of claim 1, wherein said catch flanges remain statically mated to said catch plate as said catch is displaced along said second linear path.

5. The adjustable door lock of claim 1, wherein said catch comprises:

a plurality of guides diverging away from said linear channel towards said door plate for guiding said locking bolt along said linear channel.

6. The adjustable door lock of claim 5, wherein said guides converge towards said linear channel away from said door plate for guiding said locking bolt along said linear channel.

7. The adjustable door lock of claim 1, wherein said locking bolt includes a handle located at a proximal end thereof, said locking bolt being rotated about said first linear path thereby displacing said handle between locked and unlocked positions relative to said door plate.

8. The adjustable door lock of claim 1, wherein said door plate comprises:

a main section registered generally parallel to a major longitudinal length of said locking bolt; and an auxiliary section registered generally orthogonal to said main section.

9. The adjustable door lock of claim 8, wherein said handle passes through said auxiliary section and comprises:

a first section disposed proximal to said auxiliary section, and a second section disposed distal to said auxiliary section;

wherein, when said main section is disposed subjacent to said auxiliary section, said locking bolt is prohibited from axially sliding along said first linear path.

10. An adjustable door lock for locking a misaligned or off-set door relative to a support wall adjacent to the door, said adjustable door lock comprising:

a catch plate;

a catch being adjustably connected to said catch plate and having a channel formed therein;

a door plate disposed adjacent to said catch plate; and a locking bolt slidably supported by said door plate and slidably reciprocated along a first linear path passing along said door plate and said channel when said channel of said catch is aligned with said first linear path;

wherein said catch is automatically adjusted along a second linear path orthogonally registered relative to said first linear path when said channel of said catch is aligned with said first linear path such that said channel automatically becomes axially aligned with said locking bolt as said locking bolt ingresses and egresses said catch;

wherein a proximal end of said locking bolt extends beyond said door plate when said locking bolt is extracted from said channel and retracted to an unlocked position away from said catch;

wherein said catch plate has a body and a plurality of flanges positioned on an exterior face of said body such that a corresponding gap is formed between said body and each of said flanges, respectively: wherein said catch is configured to be positioned and selectively displaced along said first linear path and through at least of one of said gaps.

11. The adjustable door lock of claim 10, wherein said first linear path is bi-directional and oriented along a horizontal plane while said second linear path is bi-directional and oriented along a vertical plane; wherein said first linear path traverses said second linear path.

12. The adjustable door lock of claim 10, wherein said locking bolt linearly, traverses said second linear path upon ingressing and egressing said linear channel respectively.

13. The adjustable door lock of claim 10, wherein said catch flanges remain statically mated to said catch plate as said catch is displaced along said second linear path.

14. The adjustable door lock of claim 10, wherein said catch comprises:

a plurality of guides diverging away from said linear channel towards said door plate for guiding said locking bolt along said linear channel.

15. The adjustable door lock of claim 14, wherein said guides converge towards said linear channel away from said door plate for guiding said locking bolt along said linear channel.

16. The adjustable door lock of claim 10, wherein said locking bolt includes a handle located at a proximal end thereof, said locking bolt being rotated about said first linear path thereby displacing said handle between locked and unlocked positions relative to said door plate.

17. The adjustable door lock of claim 10, wherein said door plate comprises:

a main section registered generally parallel to a major longitudinal length of said locking bolt; and an auxiliary section registered generally orthogonal to said main section.

18. The adjustable door lock of claim 10, wherein said handle passes through said auxiliary section and comprises:

a first section disposed proximal to said auxiliary section, and a second section disposed distal to said auxiliary section;

wherein, when said main section is disposed subjacent to said auxiliary section, said locking bolt is prohibited from axially sliding along said first linear path.

* * * * *